US005852944A

United States Patent [19]

Collard, Jr. et al.

[11] Patent Number: 5,852,944

[45] Date of Patent: Dec. 29, 1998

[54] REMOTELY CONTROLLED DOOR LOCK

[75] Inventors: Thomas H. Collard, Jr.; Larry D. Pechacek, both of San Antonio, Tex.

[73] Assignee: Stephen C. Cohen, San Antonio, Tex.

[21] Appl. No.: 844,030

[22] Filed: Apr. 18, 1997

[51] Int. Cl.[6] ..... E05B 59/00

[52] U.S. Cl. ..... 70/278; 70/107; 70/280; 292/144

[58] Field of Search ..... 70/278, 279, 280, 70/107, 277, 256, 257; 292/144, 35, 36

[56] References Cited

U.S. PATENT DOCUMENTS

| | | | |
|---|---|---|---|
| 580,820 | 4/1897 | Scheeren | 70/277 |
| 3,751,088 | 8/1973 | Schlage et al. | 70/141 |
| 3,792,888 | 2/1974 | Kambic | 292/144 |
| 3,893,723 | 7/1975 | Boule | 70/280 |
| 3,907,343 | 9/1975 | Goodwin | 292/144 |
| 4,109,494 | 8/1978 | Allemann | 70/107 |
| 4,211,443 | 7/1980 | Butts et al. | 292/341 |
| 4,509,093 | 4/1985 | Stellberger | 361/172 |
| 4,509,347 | 4/1985 | Young | 70/280 |
| 4,563,886 | 1/1986 | Kletzmaier et al. | 70/118 |
| 4,640,108 | 2/1987 | Young | 70/280 |
| 4,677,834 | 7/1987 | Hicks | 292/150 |
| 4,685,709 | 8/1987 | Kambic | 292/201 |
| 4,691,584 | 9/1987 | Takaishi et al. | 292/144 |
| 4,995,248 | 2/1991 | Liu | 70/270 |
| 4,996,525 | 2/1991 | Becker, Jr. et al. | 340/825.31 |
| 5,261,260 | 11/1993 | Lin | 70/280 |
| 5,386,713 | 2/1995 | Wilson | 70/280 |
| 5,421,178 | 6/1995 | Hamel et al. | 292/144 |

FOREIGN PATENT DOCUMENTS

| | | | |
|---|---|---|---|
| 4033840 | 4/1992 | Germany | 70/279 |
| 2163579 | 2/1986 | United Kingdom | 70/278 |

*Primary Examiner*—Darnell M. Boucher
*Attorney, Agent, or Firm*—Miller, Sisson, Chapman & Nash, P.C.

[57] ABSTRACT

A remotely controllable locking mechanism for a combination key-operated deadbolt lock and door knob latching lock for a door. A housing for the operating parts is inserted in a mortised pocket or cavity in the latch edge of the door. The electronics to operate the mechanism sends a signal to a receiver installed in the wall near the locks. Power is supplied to solenoids to simultaneously activate the locking and unlocking mechanisms of the deadbolt and the door knob latching lock. Manual key overrides are provided for the deadbolt and for the latch.

5 Claims, 5 Drawing Sheets

REMOTELY CONTROLLED DOOR LOCK

BACKGROUND OF THE INVENTION

1. Field of the Invention

Applicant's invention relates to a combination door locking system, and, more particularly, to a remotely controlled locking mechanism for a combination key-operated deadbolt lock and door knob latching lock.

2. Background Information

While remote control systems currently exist for locking and unlocking vehicles and, in some cases, locks on buildings and other structures, to date there has been no system to simultaneously lock/unlock a door having both a key-operated deadbolt lock and a door knob latching lock. Further, there has been no simple kit to convert an existing door locking system to provide for simultaneous operation of a deadbolt lock and a door knob latching lock.

U.S. Pat. No. 5,386,713 discloses a remote controlled car deadbolt lock. U.S. Pat. No. 5,261,260 discloses a remotely controlled door lock for a dog cage. Other locking mechanisms are shown in U.S. Pat. Nos. 4,509,093, 4,563,886, 4,685,709, and 4,996,525.

SUMMARY OF THE INVENTION

The present invention is a remotely controllable locking mechanism for a combination key-operated deadbolt lock and latching lock for a door. The locking mechanism includes a housing, a deadbolt operating mechanism attachable to an existing deadbolt lock in a door, a latch operating mechanism attachable to the existing door knob latching lock, and a remote control unit for a simultaneous activation of the deadbolt operating and latch operating mechanisms to lock and unlock the door. The locking mechanism may be supplied as a kit having these separate elements. Further, the locking mechanism is provided with manual override capabilities.

DETAILED DESCRIPTION OF THE PREFERRED EMBODIMENT

Figure 1:
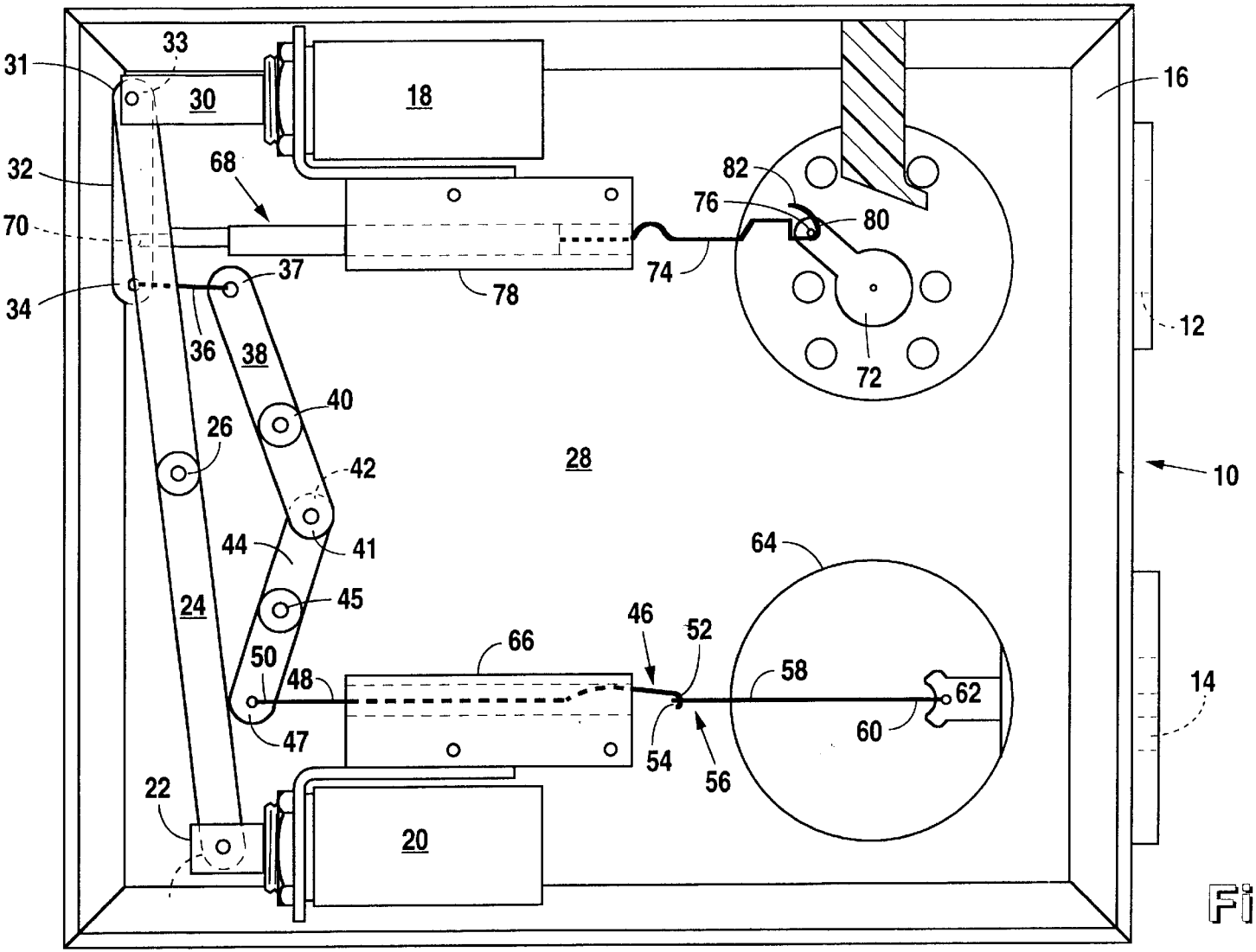
FIG. 1 illustrates the locking mechanism of the present invention in the unlocked position.

FIG. 1 illustrates the locking mechanism (10) of the present invention with both the conventional deadbolt lock (12) and the conventional door knob latching lock (14) in the unlocked or open position. The mechanism (10) is provided with an outer housing (16) which fits into a mortised pocket in the latch edge of the door. Because the housing containing the mechanism may be reversed top-to-bottom, and the latch may be reversed, one mechanism suffices for different arrangements. No major alternations to the door knob latching lock or deadbolt mechanism are necessary to accommodate the remotely controlled mechanism.

The mechanical operation of the locking mechanism (10) is illustrated in FIGS. 1–4. The remote control operation is illustrated in FIG. 5. As may be seen in FIG. 1, the arrangement provides two solenoids (18 and 20) for power. The electrical wiring is not shown but is fully understood by one of ordinary skill in the art. Solenoid (18) is the locking or closing solenoid. Solenoid (20) is the unlocking or opening solenoid.

In FIG. 1, unlocking solenoid (20) has been pulled in by operation of a remote control unit (see FIG. 5). The retraction of the solenoid arm (22) causes pivoting lever (24) attached at end (25) to arm (22) to pivot about pivot connection (26). Pivot connection (26) allows the lever (24) to pivot and secures the lever to the housing wall (28).

Because locking solenoid (8) has been deactivated, its arm (30) moves to an extended position. End (31) of pivoting lever (24) is attached to solenoid arm (30). Thus, when the "open" command is given to the remote control controller and logic circuit (see FIG. 5), lever arm (24) is pivoted into the position shown in FIG. 1.

Extending downwardly from arm (30) of solenoid (18) is a bolting lever (32). The top end (33) is attached to arm (30), while the lower end (34) is attached to a latch link wire (36). In the "open" position, bolting lever (32) pulls wire (36) attached to a first end (37) of a direction changing link (38) to cause link (38) to pivot about connection (40). Connection (40) pivotally affixes link (38) to the housing wall (28). The link (38) has a pivot ratio necessary to operate both the deadbolt and the latch, each with its own travel distance. The opposite end (41) of link (38) is pivotally attached to a first end (42) of a latching lever (44). Latching lever (44) is pivotally affixed to the housing wall (18) at connection (45). Lever (44) has a 1:1 pivot ratio. A latch pull arm (46) is attached to a second end (47) of latching lever (44). In the "open" position, the above mentioned linkages cause the latch pull arm (46) to unlock the door knob latching lock (14).

Pull arm (46) has a pull extension member (48) attached at a first end (50) to the latching lever (44). The opposite end (52) is slidingly connected through a loop (54) in end (56) of a latch pull wire (58). The opposite end (60) of wire (58) is connected to the standard latching member (62) of the door knob latching lock (14). It is well known in the art that the latching member (62) is provided with internal springs to properly actuate the latching lock.

The latch pull wire (58) is made of a strong thin thread wire and is sized to fit between the knob mechanisms of the door knob which thrust into knob opening (64) in the door. The pull extension member (48) may be a wire or rod which passes through a guide (66) attached to the housing wall (28).

The opening of the deadbolt lock (12) shown in FIG. 1 is achieved when the opening solenoid (20) is pulled in and closing solenoid (18) is extended. A bolt arm (68) is attached to a generally mid-portion (70) of the bolting lever (32). The other end of the bolt arm (68) is attached to the standard rotation member (72) of the deadbolt lock (12). The bolt arm (68) has a spring member (74) which fits around an attachment pin (76) in the rotation member (72). Movement of arm (68) causes the rotation member to move from the locked to unlocked position. Arm (68) is provided with a guide (78) which is attached to the housing wall (18).

Figure 2:
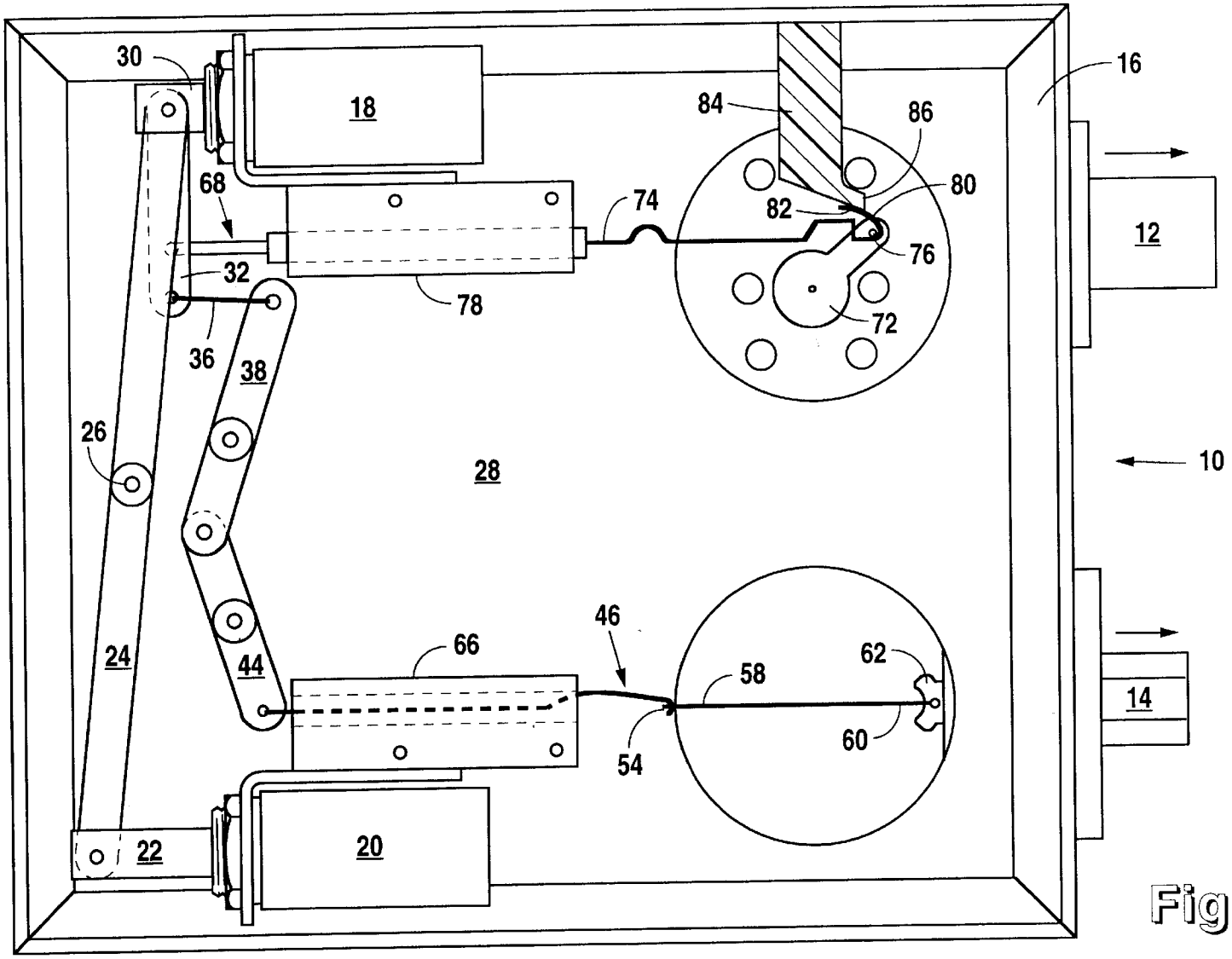
FIG. 2 illustrates the locking mechanism of the present invention in the locked position.

Turning now to FIG. 2, the locking mechanism (10) is shown in the locked or closed position. By operation of the remote control unit, closing solenoid (18) is activated, retracting arm (30) causing the pivoting lever (24) to rotate about pivot (26). Bolting lever (32) is moved to the right causing bolt arm (68) to shift in guide (78). Spring member (74) shifts to the right causing rotation member (72) to rotate the deadbolt lock (12) into the locked or closed position.

It will be noted that spring member (74) is provided with a head portion (80) having an arcuate retainer (82). The head portion moves against the pin (76) to cause the rotation. The arcuate retainer (82) passes under bolt arm wedge (84) and is held in the closed position by wedge toe (86).

FIG. 2 also illustrates that as solenoid (18) is activated and solenoid (20) is deactivated, arm (22) is extended and lever (24) pivots, bolting lever (32) shifts to the right and wire (36) also shifts to the right. As previously stated, latching member (62) is provided with internal springs which cause the member (62) to retract and the latch lock(14)to extend into the locked position. Because tension is released at wire (36) by the movement of bolting lever (32), direction changing link (38) and latching lever (44) pivot as a result of the urging of the springs in the latch member (62). Latch pull wire (46) shifts to the right and remains in loop (54). Latching lock (14) moves to the locked, or closed, position.

At this point, it should be explained that operation of the standard door knob assembly pulls the latching member (62) to release the door latch. By manually locking the knobs, latching marker (62) will remain in the locked position. However, even if the knob is manually locked, activation of the unlocking solenoid (20) results in the displacement of the latching member (62) as described above and the door may be opened.

Figure 3:
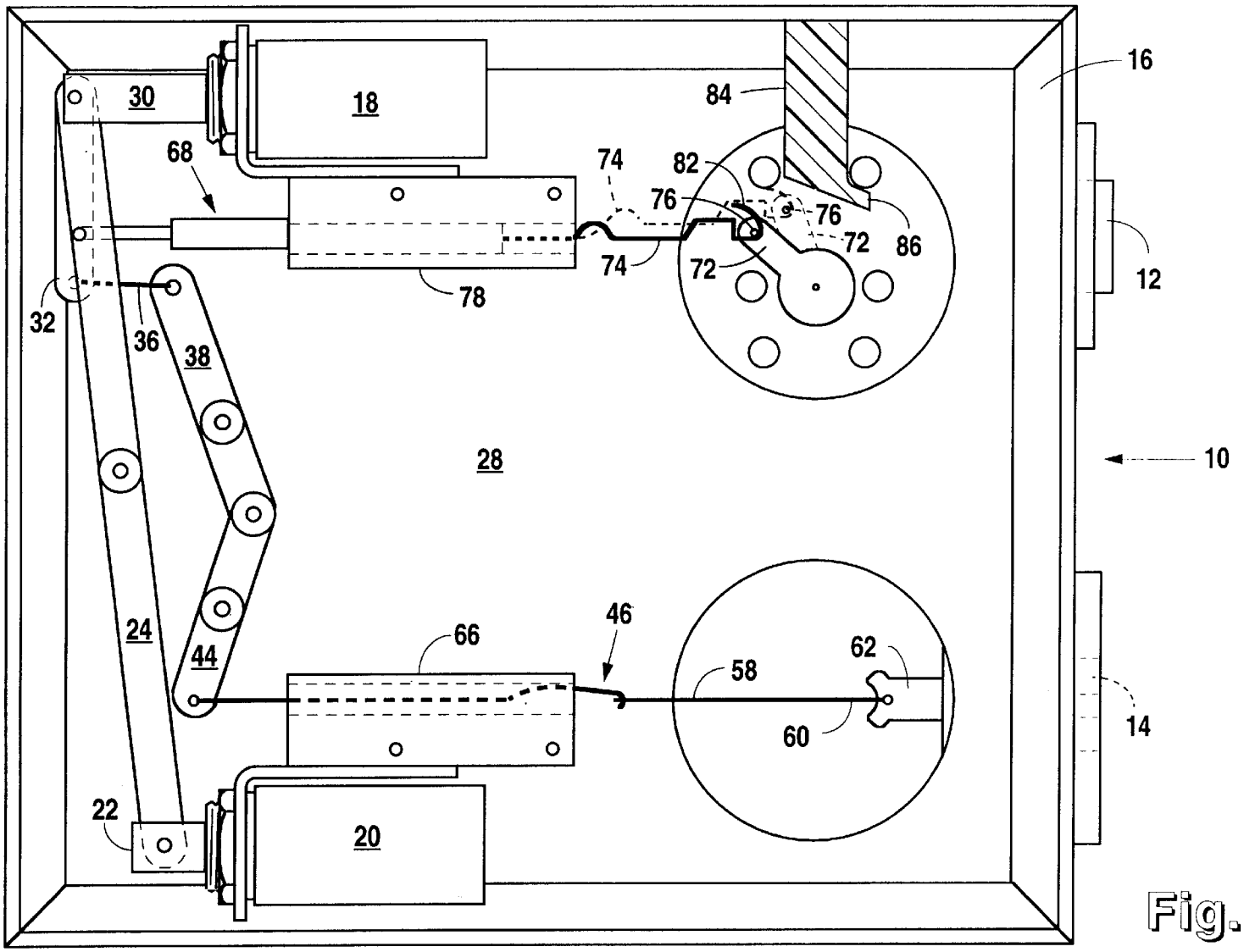
FIG. 3 illustrates the locking mechanism of the present invention in transition from an unlocked deadbolt to a locked deadbolt.

FIG. 3 illustrates the transition of the locking mechanism (10) from the unlocked to locked position. It may be seen that spring member (74) pushes against pin (76) causing the rotation member (72) to move toward the locked position. Arcuate retainer (82) moves under bolt arm wedge (84) until it held under wedge toe (86) as shown in FIG. 2.

Figure 4:
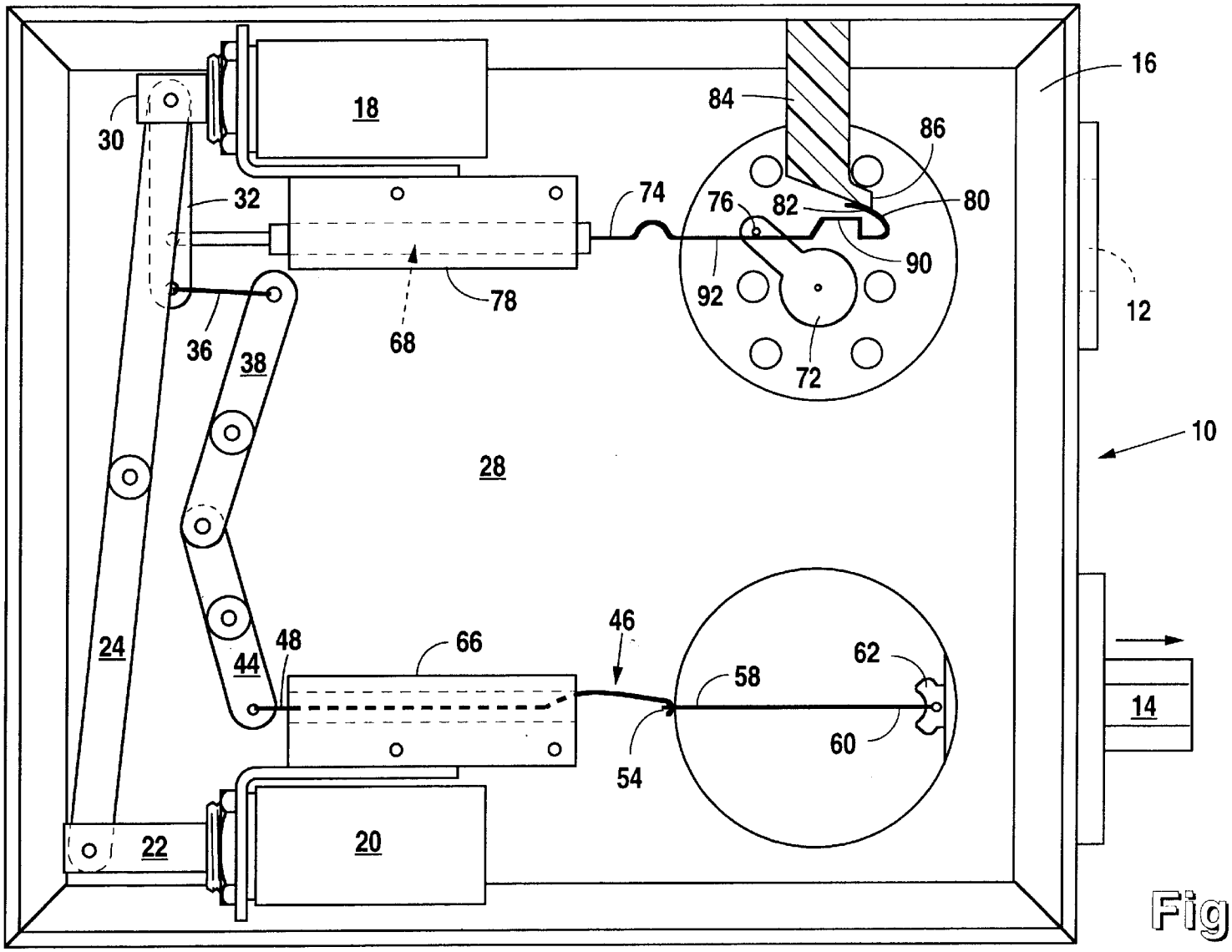
FIG. 4 illustrates the deadbolt override feature of the present invention.
Figure 5:
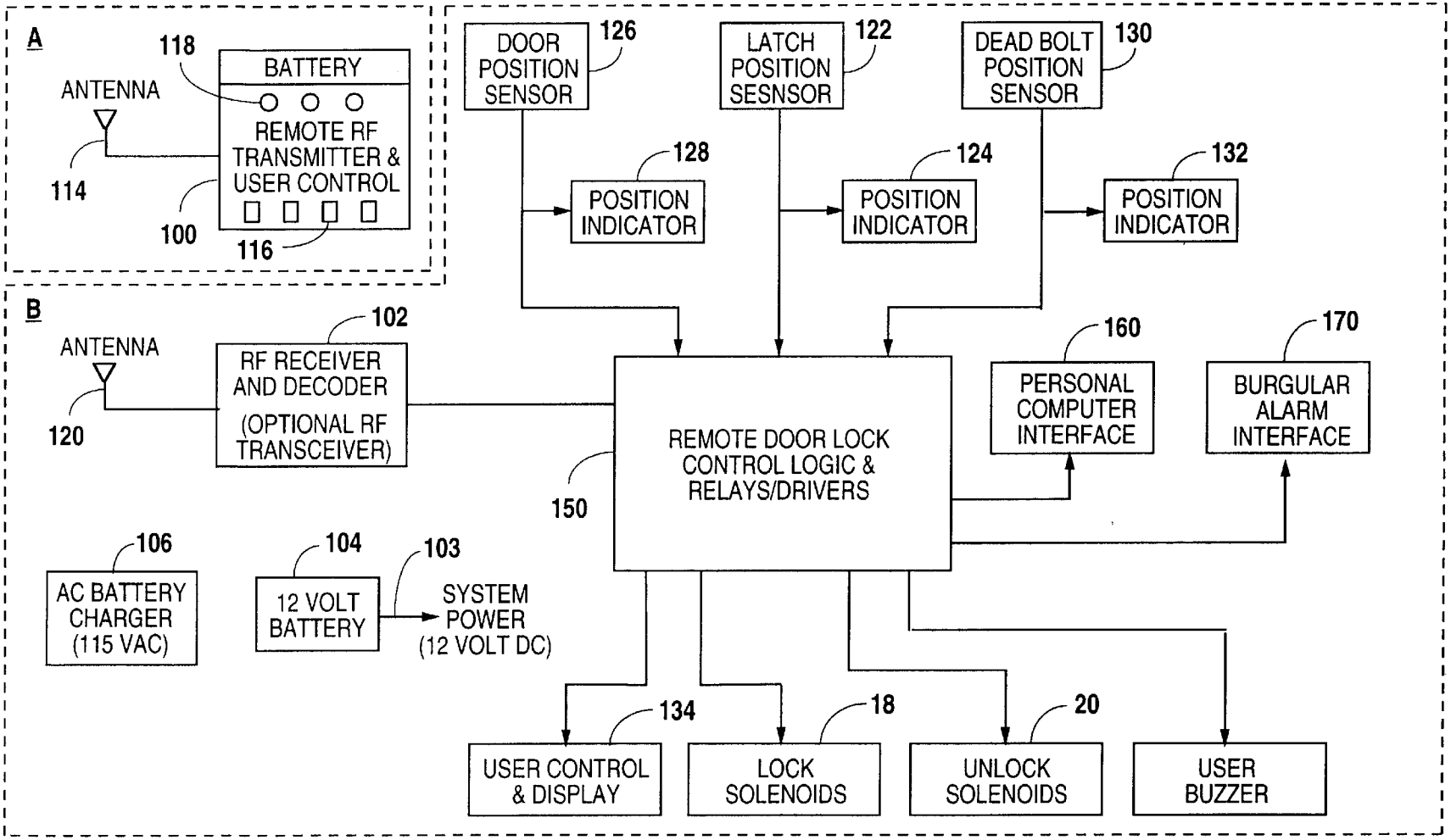
FIG. 5 is a schematic of the electronic controls of the present invention.

FIG. 4 illustrates the deadbolt override feature of the present inventive locking mechanism (10). It should be understood by looking at FIG. 4 that the locking solenoid (18) has been activated, yet it may be seen that the rotation member (72) and deadbolt lock (12) are in the unlocked position. This has been achieved by the operator manually rotating the rotation member (72) by an exterior key well known in the art. In FIG. 4, the lock pin (76) has rotated out of head (80). If the head (80) were not held under toe (86), the rotation of the key in the deadbolt lock would attempt to move the spring member (74) upwardly and back toward an unlocked position resulting in possible jamming of the lock mechanism and putting the latch in the open position. By holding head (80) in position, the pin (76) moves over shoulder portion (90) and back down on flat section (92). Thus, the deadbolt lock has been unlocked, while the knob latching lock (14) is still in the locked position.

Further, it may be noted in FIG. 4 that when the remote control unit is actuated to unlock the mechanism (10), spring member (74) will be pulled to the left, pin (76) will ride up the tapered shoulder (90) and back into the head (80).

By manually unlocking the knob latching lock (14) as discussed above, the latch pull extension (48) slides through the loop (54) in the latch pull wire (58). Again, even though the remote control unit is activated to lock both locks, the knob latching lock may be overridden. Extension (48) simply slides through the loop (54) and the locking mechanism (10) is not jammed.

It should be understood that an alternative arrangement may be used to move the latching lock and deadbolt lock that would include motors and worm gears in place of the solenoid levers and links.

The electronics to operate the mechanical parts are illustrated in FIG. 5. A signal is sent from the remote transmitter (100) (shown in box A of FIG. 5) carried on the person. The transmitter (100) may be replaced with an optional radio frequency (RF) transceiver and user control display. The receiver (102) (shown in box B of FIG. 5) is located near a power supply (104) installed in the wall adjacent the locks. Power is 12-volt direct current (DC) supplied through wires (103) which enter the housing (16) via a hole (not shown) in the back of the housing (16).

The wires (103) enter the door from the wall via a coiled spring which shields the wires (103) when the door is open. The coiled spring is in the hinge side of the door. The wires (103) pass through a drilled hole to the mortised cavity or pocket in the door holding the housing (16). A battery (104) on a constant trickle charge (106) from house alternating current provides the power to the solenoids (18 and 20).

A general description of the remote control operation may be understood by viewing FIG. 5.

The remotely controlled door lock system (10) consists of two major subsystems; namely, a remote controller (box A), and a door lock controller (box B). The remote controller (box A) consists of the following major components: battery (110), RF transmitter (112), RF antenna (114), user control switches (116), and user indicators (118). The door lock controller (box B) consists of the following major components: RF receiver (102), RF antenna (120), alternating current (AC) powered battery charger (106), 12-volt battery (104), latch position sensor (122) and indicator (124), deadbolt position sensor (126) and indicator (128), door position sensor (130) and indicator (132), user control indicator (124), lock solenoid (18), and unlock solenoid (20).

The remote controller RF transmitter (12) is used to transmit an identification number and a "lock" or "unlock" command to the door lock controller (box B). The RF receiver and decoder (102) processes the signal and passes it to the control logic (150). The control logic (150) then processes the information and commands to validate the remote controller (box A) and operate the door lock solenoids (18 and 20). The control logic (150) utilizes a microcontroller to process the remote control signals and to control relays which in turn power the door lock solenoids (18 and 20). A 12-volt battery (104) is used to supply power to the door lock controller (box B). A battery charger (106) is used to maintain battery charge. This charger (106) is powered by the utility power available at the installation site. Indicators are used to indicate the latch position and the deadbolt position. The position information can be obtained directly (optimal) via mechanical or optical switches or indirectly via electronic control signals. The door lock controller sensors and optionally the applicable indicators, and the door lock solenoids are mounted in the door. All other door lock controller components are mounted in convenient locations within the walls and attic spaces surrounding the door.

Many design and functional variations are available to the basic design. For instance, the remote controller might also employ an RF receiver, thus enabling door lock controller information to be displayed remotely to the user. Such information might include the door position and each of the door lock positions. Other controls might also be added to the remote controller. These might include lighting control, garage door control, security system control, or remote lock/unlock disable control. Additionally, technologies other than RF might be used for enabling the communications between the remote control and the door lock controller. Such technology might be infrared, laser, ultrasonics, or microwave. The door lock controller might provide an interface capability to a personal computer (160), a security system (170) such as a monitor and access control system or even a simple burglar alarm. Additional sensor inputs might be added enabling video camera operation or visitor/intruder detectors such as pressure sensitive pads. Optional local user controls might be employed to allow enhancements or discriminating product features such as a local switched lock/unlock control. Remote control security can be enhanced using various encryption schemes such as time-based coding, challenge-and-response, rolling-code encryption or future algorithms unknown today. Optional local user indicators, displays, or audible tones might be added to provide such information as system power status, battery charge status, door lock/unlock solenoid activation, or even visitor/intruder presence.

In operation, a fixed code transmitter (100) with over 60,000 possible security codes and a range of approximately 150 feet is used to transmit a command to lock or unlock the door. The user initiates the sending of the command by pushing a button switch (116) on the remote control. The same push button is used to both lock and unlock the door. Alternatively, separate push buttons could be used. Using the single button design, pressing the button will cause the lock solenoid to energize if "unlock" occurred previously, and likewise, if a "lock" had occurred previously, then the unlock solenoid will be energized. A light emitting diode indicator (118) is used to show the user that transmitter activation has occurred while depressing the lock/unlock push button switch.

The RF receiver (102) located within the door lock controller receives the transmission from the remote control and passes the security code and switch command to the micro-controller. The micro controller then determines if the command received is valid and determines the command activated. The micro controller will then energize either the lock relay or the unlock relay based upon the prior state. In turn, the energized lock relay will energize the lock solenoid or the unlock relay will energize the unlock solenoid. A light emitting diode will be turned off if the door unlock relay was last energized and will blink on and off periodically if the lock relay was last energized. Alternatively, steady state indicators could be used to indicate actual deadbolt and latch lock positions. In this case, a mechanical, optical, or perhaps proximity switch could be used to sense the lock position.

The device may use an Intel® 8031 micro controller as the system controller. Alternatively, programmable logic devices and other types of micro controllers or microprocessors and even simple sequencing logic could be used to control the door lock system. The choice of device depends upon the functional and operational requirements of the product model. Currently, many semi-conductor manufacturers are introducing new devices specialized in keyless and wireless entry systems. Representative manufacturers include National Semiconductor®,Excel®, Motorola®, and Microchip Technology®. These devices target both the system control and the system security.

During system installation, the RF receiver (102) is programmed with the security code of the RF transmitter (100) to be used. The RF receiver (102) may be programmed (or trained) to accept acknowledged multiple transmitter codes.

The door lock controller (box B) components are powered by a 12 volt, 4.5 ampere hour sealed lead acid battery (104). The battery (104) provides the surge current required during solenoid activation. A 12 volt DC battery charger (106) is used to continuously "trickle" charge the battery and thus maintain the battery charge level.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A remotely controllable locking mechanism for a combination key-operated deadbolt lock and latching lock comprising:

a housing;

a first locking solenoid mounted within said housing;

a second unlocking solenoid mounted within said housing;

a pivoting lever attached at a first end to said first locking solenoid, attached at a second end to said second unlocking solenoid, and pivotally attached at a mid-portion to said housing;

a bolting lever attached at a first end to said first locking solenoid, attached at a second end to a first end of a latch link wire, and attached at generally a mid-point to a first end of a bolt arm, said bolt arm adapted to be attached to a bolt rotation member of said deadbolt lock;

a direction changing link attached at a first end to a second end of said latch link wire and pivotally attached to said housing;

a latching lever pivotally attached to said housing and attached at a first end to a second end of said direction changing link and attached to a latch pull arm, said latch pull arm adapted to be attached to a latching member of said latching lock; and a remote control unit for activating said first locking solenoid and said second unlocking solenoid to lock and unlock said deadbolt lock and said latching lock.

2. The locking mechanism of claim 1 wherein said bolt arm further comprises a spring member attached to a second end of said bolt arm between said bolt rotation member and said bolt arm.

3. The locking mechanism of claim 2 wherein said latch pull arm further comprises a latch pull extension attached at a first end to said latching lever and slidingly connected at a second end to a pull loop in a latch pull wire adapted to be attached to said latching member of said latching lock.

4. The locking mechanism of claim 3 further comprising:

a bolt arm guide attached to said housing; and a latch pull arm guide attached to said housing.

5. The locking mechanism of claim 1 further comprising:

a bolt arm wedge affixed to said housing and cooperating with said bolt arm to enable said deadbolt lock to be unlocked with a key without remote activation of said solenoids.

* * * * *